US006964236B2

(12) United States Patent
Schücker et al.

(10) Patent No.: US 6,964,236 B2
(45) Date of Patent: Nov. 15, 2005

(54) LEVELING DEVICE WITH AN ADJUSTABLE WIDTH

(75) Inventors: Franz-Josef Schücker, Castrop-Rauxel (DE); Claus Jürgen Bast, Düsseldorf (DE); Rolf Weiershausen, Dortmund (DE)

(73) Assignee: Thyssen Krupp EnCoke GmbH, Bochum (DE)

( * ) Notice: Subject to any disclaimer, the term of this patent is extended or adjusted under 35 U.S.C. 154(b) by 81 days.

(21) Appl. No.: 10/380,778

(22) PCT Filed: Jun. 30, 2001

(86) PCT No.: PCT/EP01/07513

§ 371 (c)(1),
(2), (4) Date: Sep. 12, 2003

(87) PCT Pub. No.: WO02/24833

PCT Pub. Date: Mar. 28, 2002

(65) Prior Publication Data

US 2004/0020413 A1 Feb. 5, 2004

(30) Foreign Application Priority Data

Sep. 20, 2000 (DE) ..... 100 46 487

(51) Int. Cl.[7] ..... F23K 3/00; C10B 37/02

(52) U.S. Cl. ..... 110/230; 110/101 R; 110/114; 201/40; 414/587

(58) Field of Search ..... 110/230, 231, 289, 110/101 R, 109, 101 A, 114, 165 R, 170; 432/200; 266/135; 201/40, 41; 202/262, 202/270; 414/587, 804

(56) References Cited

FOREIGN PATENT DOCUMENTS

| | | | |
|---|---|---|---|
| DE | 279 307 | 10/1914 | |
| DE | 497 569 | 5/1930 | |
| DE | 11 10 134 | 7/1961 | |
| DE | 2 317 685 | 10/1974 | |
| DE | 32 45 552 | 6/1984 | |
| JP | 63248889 A | * 10/1988 | ..... C10B 37/02 |

* cited by examiner

*Primary Examiner*—Kenneth Rinehart
(74) *Attorney, Agent, or Firm*—Collard & Roe, P.C.

(57) ABSTRACT

The device relates to a device for leveling the coal filled in the retort of a coke oven, comprising a leveler bar (2) connected with a leveler bar drive (1) that can be moved into and out of the retort (4) through a leveling opening (3), and performs a leveling movement back and forth in the retort (4). According to the invention, the leveler bar (2) has a rake blade (5) on its front end with a width that can be adjusted by an operating device (6) arranged in the leveler bar (2).

3 Claims, 3 Drawing Sheets

LEVELING DEVICE WITH AN ADJUSTABLE WIDTH

CROSS REFERENCE TO RELATED APPLICATIONS

Applicants claim priority under 35 U.S.C. §119 of German Application No. 100 46 487.4 filed Sep. 20, 2000. Applicants also claim priority under 35 U.S.C. §365 of PCT/EP01/07513 filed Jun. 30, 2001. The international application under PCT article 21(2) was not published in English.

The invention relates to a device for leveling the coal with which the retort of a coke oven is filled, comprising a leveler bar that is connected with a leveler drive and that can be moved in and out the retort and performs a leveling movement back and forth in the retort.

A device with the structure and purpose of application described above is known from DE-A 23 17 685. The leveler bar is driven in and out through the door of the oven, which, for reasons of the construction, is clearly narrower than the width of the retort. The result thereof is that the cones of heaped-up coal forming when the retort is filled from the topside cannot be uniformly level toward the walls of the retort. In a coking process in non-recovery coke ovens, which are operated with a flat filling of the retort according to the flat-bed coking process, a uniform bulk height is required across the entire base area of the retort.

In connection with a leveling device known from DE-A 32 45 552, the front end of the leveler bar is provided with a head that contains two sliding parts mounted on jointed levers. The sliding parts can be pivoted with the help of an actuating device from an idle position, in which the sliding parts are disposed within the headpiece, into an operating position by spreading them. The sliding parts are comprised of sliding shoes and sliding rollers and, in their operating positions, slide on slanted belt sections. In this way, the leveler bar is provided with a support at its front end, which is lowered on correspondingly shaped slanted surfaces, for which provision is made in the gas collection chamber, as soon as the leveler bar is flexing through. The leveler bar is suited for particularly long retorts. No contribution is made by the headpiece to uniform leveling of the coal.

The invention is based on the problem of providing a leveling device by means of which the cones of heaped up bulk can be leveled in the retort very uniformly up to the walls of the retort.

For resolving this problem, the instruction of the invention specifies that the leveler bar is equipped at its front end with a rake blade with a width that can be adjusted by means of an operating device mounted on the leveler bar. The maximum width of the rake blade preferably approximately corresponds with the width of the retort. The effective leveling area can be considerably widened by means of the operating device after the leveling bar has been driven into the retort. This permits an efficient operation and uniform leveling.

According to a preferred embodiment of the construction, the rake blade is comprised of two wings pivot-mounted on the front end of the leveler bar. As the leveler bar is being driven into and out of the retort through the leveling opening, these wings rest against the leveler bar like a plow, and can be folded open in the retort by an adjusting movement of the operating device. Each wing is articulated with a lever on an adjusting rod, which is supported in the leveler bar in an axially displaceable manner, for example on support rollers, and, at its rearward end, connected with an adjusting device. The adjusting device may be comprised of a hydraulic cylinder-and-piston system.

In the basic position, the wings are pivoted inwards like a plow. This permits the arrangement to pass through the leveling opening, which is substantially narrower as compared to the width of the retort. The basic position of the rake blade is maintained as the leveler bar is moving forward. As the leveler bar is moving forward in the retort, the inwards-pivoted wings aligned in the form of a plow push the coal away from the center of the retort in the direction of the lateral walls of the retort. After the leveler bar has driven though the retort up to the end of the latter, the adjusting rod is extended, whereby the wings are pivoted forwards via the lever system until the outer surface of the spread rake blade is aligned substantially parallel with the wall of the retort disposed opposite the leveling opening. The raking area is widened in the course of in this process. Furthermore, the pivoting movement of the wings distributes coal into the corner areas of the retort.

According to another advantageous embodiment of the invention, the inner surfaces of the rake blade are arranged at an acute angle in relation to the outer surface of the rake blade, whereby the apex of the angle is located in each case at the outer end of the rake blade and selected in such a manner that the extended rake blade pushes coal toward the lateral walls of the retort as the leveler bar is moving back. In the course of this rearward leveling movement of the leveler bar, the wings of the rake blade are extended, and the rake blade has its largest span width. The described profiling of the wings produces a plow-like raking profile that conveys coal still forming cones of heaped-up coal from the edge of the already-leveled area to the side walls of the retort. The return movement of the leveler bar is stopped just before it reaches the door of the retort, with the result that the coal filling is uniformly leveled up into the corner areas of the retort. Subsequently, the leveler bar is driven forwards to such an extent that the wings of the rake blade can be swung back. After the rake blade has assumed its basic position and the wings again rest against the leveler bar like a plow, the leveler bar is driven out of the retort and the leveling process is finished.

The invention is explained in the following with the help of the drawing showing only one exemplified embodiment of the invention. The following is schematically shown in the drawing.

Figure 1:
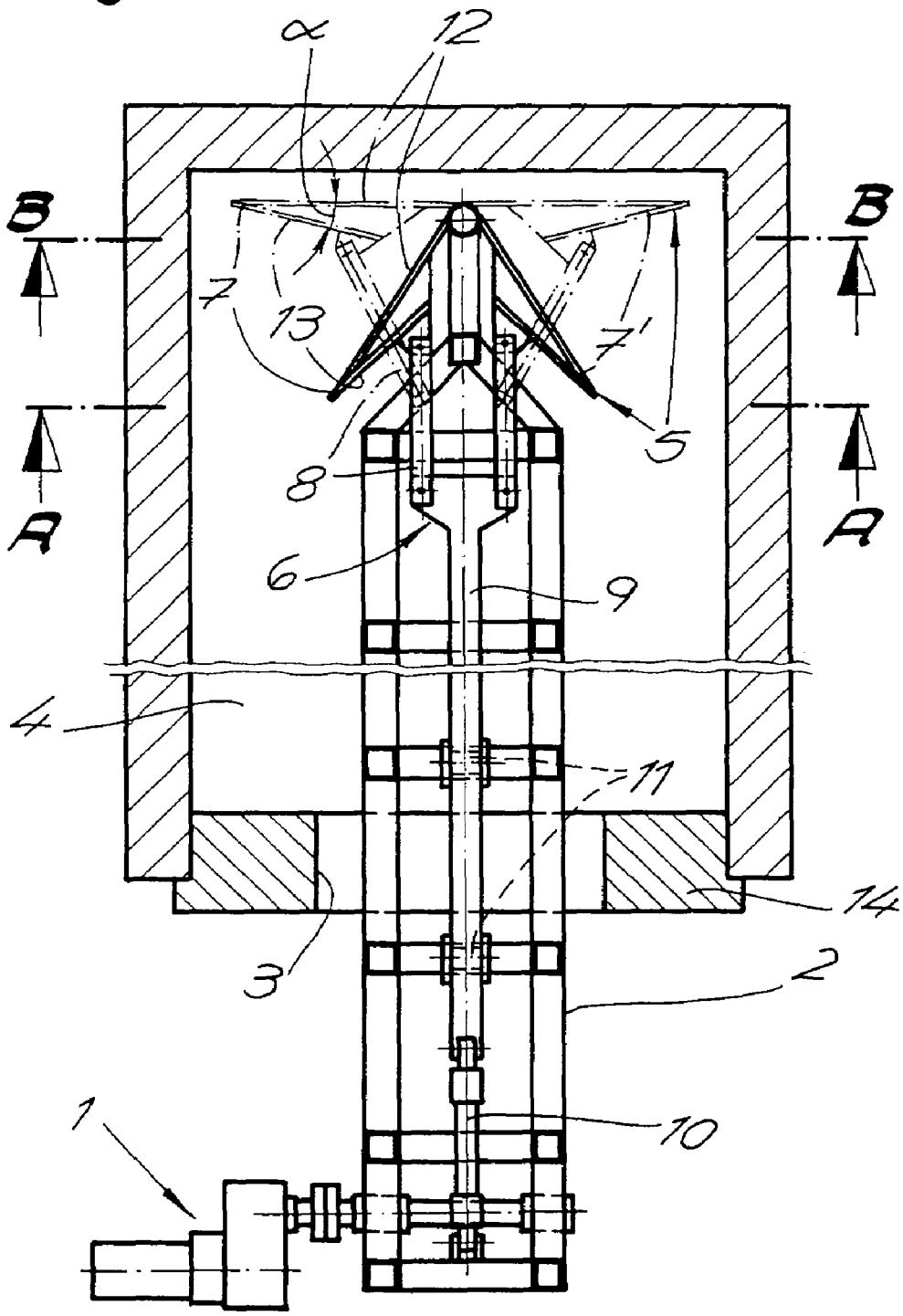
FIG. 1 is a horizontal section through the retort of a coke oven with a device for leveling coal filled in the retort viewed from the top.

The leveling device shown in FIG. 1 comprises a leveler bar 2 that is connected with a leveler bar drive 1. This leveler bar can be driven into and out of the retort 4 of a coke oven through a leveling opening 3 and performs a leveling movement by driving back and forth in the retort. A rake blade 5 is mounted on the front end of the leveler bar 2; the span width of the rake blade can be adjusted by an operating device 6 that is arranged in the leveler bar 2. The rake blade 5 is comprised of the two wings 7, 7', which are pivot-mounted on the front end of the leveler bar 2. When the latter is driven into or out of the retort through the leveling opening 3, these wings rest against the leveler bar 2 like a plow, and then can be folded out inside the retort 4 by an adjusting movement of the operating device 6, into the position indicated by dot-dashed lines. The wings 7, 7' each are articulated on an adjusting rod 9 with a lever 8. The adjusting rod 9 is supported in the leveler bar 2 in an axially displaceable manner and, at its rearward end, connected with an adjusting device 10. The adjusting rod 9 is supported on the support rollers 11 only indicated in FIG. 1. In the exemplified embodiment, the adjusting device 10 consists of a hydraulic cylinder that is arranged in the leveler bar.

FIG. 1 shows that the wings 7, 7' can be swung forwards by an adjusting movement of the adjusting rod 9, from the basic position indicated in FIG. 1 by fully drawn lines, until the outer surface 12 of the rake blade 5 is substantially aligned parallel with the wall of the retort disposed opposite the leveling opening 3. In this position, the rake blade 5 has its largest wing span. The representation in FIG. 1 shows, furthermore, that the inner surfaces 13 of the rake blade are arranged at an acute angle $\alpha$ in relation to the outer surface of the rake blade. The apex of the angle $\alpha$ is in each case located at the outer end of the rake blade 5 and selected in such a manner that when the leveler bar is moving backwards, the spread rake blade 5 pushes coal to the lateral walls of the retort.

Figure 2:
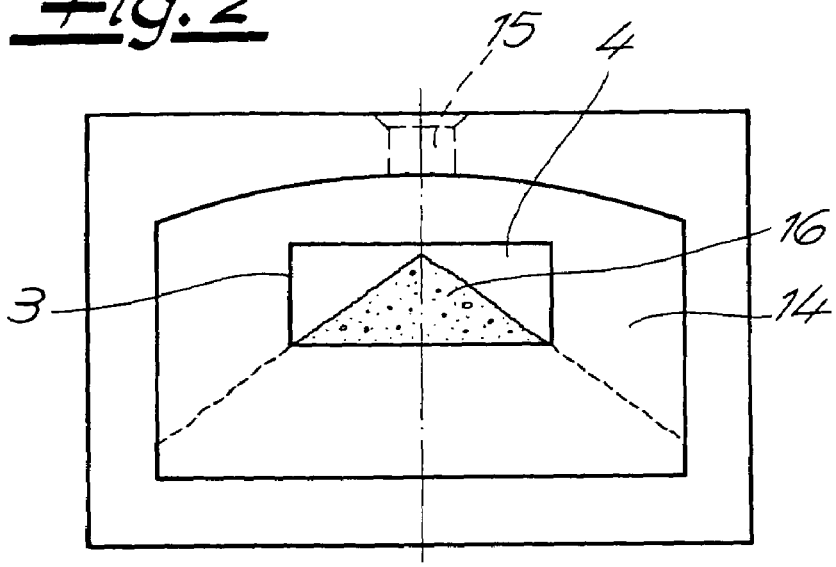
FIG. 2 shows the retort filled with coal prior to the leveling operation.

FIG. 2 shows the retort 4 filled with coal viewed from the retort door 14. For reasons of construction, the leveling opening 3 in the retort door 14 is significantly narrower than the width of the retort 4. The coke oven is operated according to the principle of flat-bed coking with a flat filling of the retort. The retort is filled through the filling holes 15 located in the ceiling of the retort. Heaps of coal in the form of the pronounced cones 16 build up underneath the filling holes. Flat-bed coking requires that the coal is heaped up to a uniform filling level over the entire base area of the retort, so that the necessity of leveling ensues. The leveling device is shown in FIGS. 3 and 4 with the use of the device represented in FIG. 1.

Figure 3:
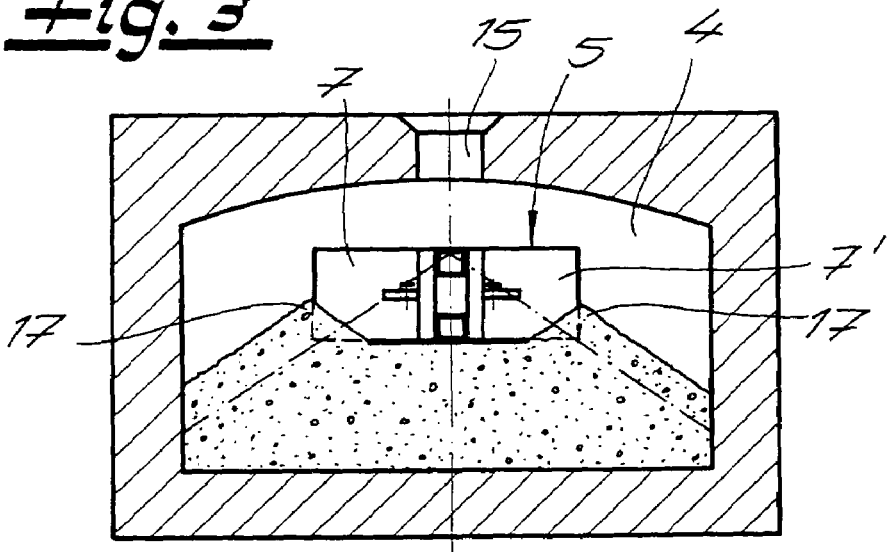
FIGS. 3 and 4 show the leveling operation with the use of the leveling device shown in FIG. 1.

The section A—A from FIG. 1 shown in FIG. 3 shows the rake blade 5 in the course of the forward movement of the leveler bar 2. The wings 7, 7' of the rake blade 5 are pivoted inwards in the form of a plow. When it is assuming this basic position, the rake blade 5 can be driven into the retort 4 through the leveling opening 3. This basic position is maintained during the forward movement. In the course of this forward movement, the wings 7, 7' set in the form of a plow push the coal away from the center of the retort in the direction of the walls of the retort. The smaller cones 17 of heaped coal still remaining on both sides of the leveled area are eliminated during a later return movement of the leveler bar 2.

The leveler bar 2 is driven through the retort 4 up to the end of the latter. After the leveler bar 2 has reached its final position at the end of the forward movement, the wings 7, 7' forming the rake blade 5 are pivoted outwards and moved into the position represented by the dash-dotted line in FIG. 1. In this position, the outer surface 12 of the rake blade 5 is substantially aligned parallel with the wall of the retort disposed opposite the leveling opening 3. The raking range is widened by the pivoting movement of the wings 7, 7', and, furthermore, coal is distributed to the corner areas of the retort 4.

Figure 4:
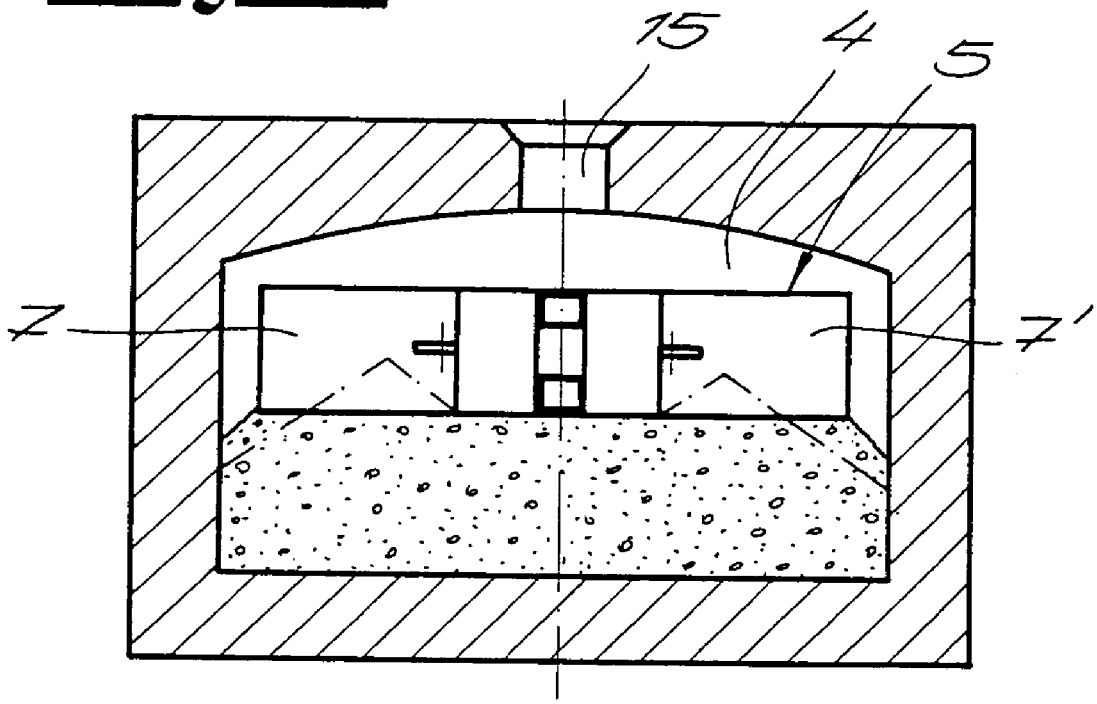

The section B—B from FIG. 1 shown in FIG. 4 shows the rake blade 5 with the wings 7, 7' pivoted outwards. The rake blade 5 remains in this position as the leveler bar 2 is moving back. The profiling of the wings 7, 7' on their inside surfaces produces a plow-like raking profile that moves the remaining coal to the lateral walls of the retort 4 as the leveler bar 2 is moving back. FIG. 4 shows the leveling process as the leveler bar is moving back. So as to assure that the coal filling is uniformly leveled in the front corner areas of the retort 4 as well, the return movement of the rake blade 5 is stopped only just before the retort door 14 has been reached. The leveler bar 2 is subsequently advanced by a forward movement to such an extent that the wings 7, 7' can be pivoted back into the basic position. After the wings 7, 7' have been swiveled back, the leveler bar 2 is pulled out of the leveling opening 3.

What is claimed is:

1. A device for leveling the coal filled in the retort of a coke oven, comprising a leveler bar (2) connected with a leveler drive (1) and drivable into and out of the retort (4) through a leveling opening (3) and performing a leveling movement back and forth in the retort (4) whereby the leveler bar (2) has a rake blade (5) at its front end, the span width of which is adjustable by an operating device (6) arranged in the leveler bar (2), characterized in that the rake blade (5) is comprised of two wings (7, 7') swivel-mounted on the front end of the leveler bar (2) and resting against the leveler bar (2) in the form of a plow as the latter is being driven in and out through the leveling opening (3), and being unfoldable in the retort (4) by a setting movement of the operating device (6); and that the inside surfaces (13) of the rake blade (5) are arranged at an acute angle in relation to the outside surface (12) of the rake blade (5), whereby each apex of the angle is located at the outer end of the rake blade (5), and whereby the angle is selected in such a manner that coal is pushed by the extended rake blade (5) toward the lateral oven walls as the leveler bar (2) is being driven backwards.

2. The device according to claim 1, characterized in that the wings (7, 7') each are connected in an articulated manner to a setting rod (9) axially displaceably supported in the leveler bar (2) and connected at its rearward end with a setting device (10).

3. The device according to claim 2, characterized in that the outer surface (12) of the spread rake blade (5) is substantially aligned in parallel with the oven wall disposed opposite the leveling opening (3).

* * * * *